US008307610B2

(12) United States Patent
Landers

(10) Patent No.: US 8,307,610 B2
(45) Date of Patent: Nov. 13, 2012

(54) INSULATIVE METALLIC CHANNEL AND CONSTRUCTION ASSEMBLY

(76) Inventor: LeRoy A. Landers, Portland, OR (US)

( * ) Notice: Subject to any disclaimer, the term of this patent is extended or adjusted under 35 U.S.C. 154(b) by 73 days.

(21) Appl. No.: 12/786,807

(22) Filed: May 25, 2010

(65) Prior Publication Data

US 2011/0289876 A1 Dec. 1, 2011

(51) Int. Cl.
*E04C 3/00* (2006.01)

(52) U.S. Cl. ..... 52/846; 52/481.1; 52/144; 52/483.1

(58) Field of Classification Search ..... 52/144, 52/145, 781.3, 474, 483.1, 481.1, 836, 846
See application file for complete search history.

(56) References Cited

U.S. PATENT DOCUMENTS

| | | | | |
|---|---|---|---|---|
| 772,662 | A | 10/1904 | Mallory | |
| 939,749 | A | 11/1909 | Sagendorph | |
| 1,643,577 | A | 9/1927 | Dornier | |
| 1,706,945 | A * | 3/1929 | White | 52/376 |
| 1,803,589 | A | 5/1931 | Bohnsack | |
| 2,268,517 | A | 12/1941 | Small | |
| 2,410,922 | A | 11/1946 | Balduf | |
| 2,633,945 | A | 4/1953 | Millier | |
| 2,664,179 | A | 12/1953 | Gwynne | |
| 2,904,851 | A * | 9/1959 | Griffin et al. | 52/481.1 |
| 2,931,470 | A | 4/1960 | Brown | |
| 2,950,789 | A | 8/1960 | Davis et al. | |
| 3,083,794 | A | 4/1963 | Stovall | |
| 3,129,792 | A | 4/1964 | Gwynne | |
| 3,243,930 | A | 4/1966 | Slowinski | |
| 3,753,324 | A | 8/1973 | Puccio | |
| 3,956,998 | A | 5/1976 | Bavetz | |
| 4,016,700 | A | 4/1977 | Blomstedt | |
| 4,235,057 | A | 11/1980 | Teeters | |
| 4,346,543 | A * | 8/1982 | Wilson et al. | 52/404.2 |
| 4,453,363 | A * | 6/1984 | Koller | 52/481.1 |
| 4,455,806 | A | 6/1984 | Rice | |
| 4,619,098 | A | 10/1986 | Taylor | |
| 4,713,921 | A | 12/1987 | Minialoff et al. | |
| 4,793,113 | A | 12/1988 | Bodnar | |
| 5,095,678 | A | 3/1992 | Murphy | |
| 5,157,883 | A | 10/1992 | Meyer | |
| 5,203,132 | A | 4/1993 | Smolik | |
| 5,222,335 | A | 6/1993 | Petrecca | |

(Continued)

FOREIGN PATENT DOCUMENTS

DE 3619398 C1 7/1987

(Continued)

OTHER PUBLICATIONS

Anderson, "Studs of Steel", Home Energy, Jul./Aug. 1994, 11(4), 9-10.

(Continued)

*Primary Examiner* — William Gilbert
*Assistant Examiner* — Gisele Ford
(74) *Attorney, Agent, or Firm* — Woodcock Washburn LLP

(57) ABSTRACT

An insulative metallic channel for supporting a construction assembly and resisting heat transfer includes an elongated web and at least one flange. The flange includes two ridges along the length of the flange and an inwardly-bent portion of the flange between the two ridges. The inwardly-bent portion extends between the two ridges approximately the entire width of the flange. An insulative material substantially fills the inwardly-bent portion of the flange.

25 Claims, 13 Drawing Sheets

U.S. PATENT DOCUMENTS

| | | | | | |
|---|---|---|---|---|---|
| 5,285,615 | A | | 2/1994 | Gilmour | |
| 5,592,796 | A | * | 1/1997 | Landers | 52/241 |
| 5,924,256 | A | * | 7/1999 | Ito | 52/481.1 |
| 6,125,608 | A | * | 10/2000 | Charlson | 52/847 |

FOREIGN PATENT DOCUMENTS

| | | |
|---|---|---|
| EP | 0249085 | 8/1991 |
| GB | 580 | 0/1894 |
| JP | 5-125768 | 5/1993 |

OTHER PUBLICATIONS

Barbour et al., "Thermal Performance of Steel-Framed Walls, Report Project No. 1006(2178)", The American Iron and Steel Institute, Nov. 1994, 75 pages.

Frey et al., "Hot Box Testing of Steel Studs", Portland State University, Sep. 18, 1992, 25 pages.

Hawes, "Steel-Framing Correction table Proposed for Residential Energy Standard" Energy Design Update, May 1994, 14(5), 3-4.

Malin, "Steel or Wood Framing", Environmental Building News, Jul./Aug. 1994, 3(4), pp. 1, 10-18.

Nielson, "Ghost Mark Prevention on Steel-Framed Walls", Energy Design Update, Apr. 1995, 15(4), 5-6.

Seaton, "ASHRAE to Study Steel Framing and Foam Sheathing Performance", Energy Design Update, Jul. 1993, 13(7), 2 pages.

Villar, "Research Center Seeking Ways to Fix Thermal Problems in steel framing", Energy Design Update, Mar. 1994, 14(3), 3-4.

* cited by examiner

INSULATIVE METALLIC CHANNEL AND CONSTRUCTION ASSEMBLY

TECHNICAL FIELD

The subject matter described herein relates generally to metallic channels used in various types of construction and, more particularly, to improved configurations which reduce thermal conductivity and provide acoustic dampening between the metallic channels and planar constructions components.

BACKGROUND

Metal channels are commonly used as components in many types of built assemblies. Currently, one of the primary problems associated with the use of these metal channels as framing members involves their high level of thermal transmission due to conductivity. In these built assemblies, a thermal bridge is created by the metal channels through which heat may be transferred. The transfer of heat across this thermal bridge, in turn, manifests itself in the form of increased energy consumption. A number of attempts to solve this problem have been proposed; however, all of these prior proposals present significant disadvantages that severely limit and in some cases eliminate their practical application and use.

For example, U.S. Pat. No. 5,235,054 to Gilmour describes a thermal metallic building stud which attempts to limit contact between the metal framing member and adjacent materials via an upset pattern of punched protuberances which are pushed from the interior surfaces outwardly and cover the length and width of the stud flange. These punched projections present two significant problems: one involving the common use of mechanical fastening devices in conjunction with metal framing and one regarding the industry standardized structural widths currently used for metal framing members. Firstly, the distribution of projections across the width of the flange and away from the web serves as an obstruction to commonly used fasteners such as screws or nails. When hit, these protrusions can cause those fasteners to deflect and bend. This is illustrated in FIGS. 4 and 5 of the Gilmore patent. Secondly, unless the total structural depth of the stud is reduced accordingly, whereby its load bearing capacity is altered, the increased dimension resulting from the outwardly struck protuberances will hinder the use of the described thermal metallic building stud within standardized systems of metal runners and aim channels.

Another example is U.S. Pat. No. 5,592,796 to Landers, which describes how to limit contact between the metal framing member and adjacent materials via a inwardly bent flange, resulting in two contact points between the framing member and the adjacent materials, which extend for the length of the framing member. These two points create an air pocket between the framing member and the adjacent materials. While this air pocket does reduce the amount of thermal transfer between the framing member and the adjacent materials, the thermal transfer could be further reduced. Also, the air pocket creates problems with the use of fasteners which secure the framing member to the adjacent materials. First, when a fastener is inserted through the adjacent materials, it is free to move within the air pocket and may not squarely contact the flange of the framing material. Second, the air pocket provides no support for the adjacent materials. As the fastener is secured, it can be secured so tightly as to deform or break the adjacent materials.

Another problem with traditional structural framing members is that they act as a bridge to transmit acoustic vibrations.

When assembled into a built assembly, traditional structural framing members transmit sounds from one side of the built assembly to the other side of the built assembly. For example, when the built assembly is a wall, sounds are transmitted from one side of the wall to the other. This acoustic transmission can be disadvantageous, especially in applications such as apartment buildings, hotels, sound-sensitive laboratories, and the like.

As a result, a need currently exists for thermally-improved metallic channels which possess characteristics not exhibited by the prior art. A need also exists for a method of designing a construction assembly which possess characteristics not exhibited by the prior art.

SUMMARY

The present invention relates to a structural metallic channel which provides a low level of thermal conductivity between adjacent materials of a construction assembly, which provides guidance for fasteners attaching the structural metallic channel to the adjacent materials, and which provides structural backing for the adjacent materials.

The present invention also relates to a method of designing an acoustically dampening construction assembly utilizing a structural metallic framing member. The particular metallic framing member is chosen based on its characteristics to aid in dampening acoustic transmissions in the construction assembly.

Further objects and advantages of this invention will become apparent from a consideration of the drawings and ensuing description, wherein details have been described for purposes of disclosure without intending to limit the scope of protection set forth in the appended claims.

DETAILED DESCRIPTION OF ILLUSTRATIVE EMBODIMENTS

Figure 1A:
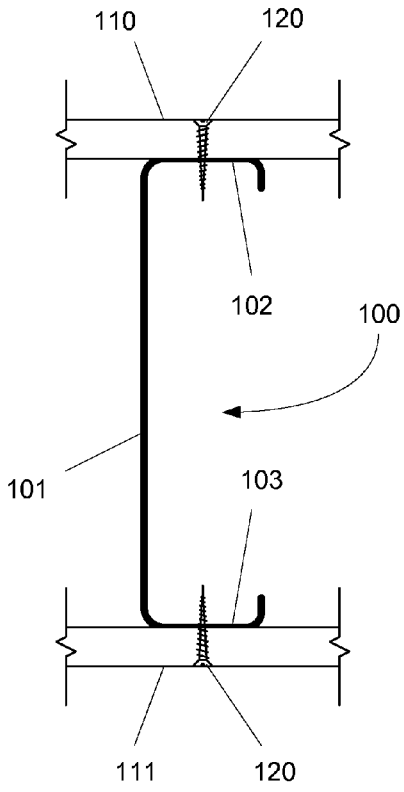
Figure 1A Prior Art
FIG. 1A illustrates a cross sectional view of a traditional metallic framing member 100 in a construction assembly.

FIG. 1A illustrates a cross sectional view of traditional metallic framing member 100 in a construction assembly.

Traditional metallic framing member 100 includes a web 101 and two flanges 102 and 103 which are perpendicular to the web 101. The construction assembly also includes two planar construction components 110 and 111. Planar construction components 110 and 111 can be any type of planar components, such as dry wall, sheet rock, plywood, or any similar material. The planar construction components 110 and 111 are secured to the traditional metallic framing member 100 using fasteners 120.

When assembled as shown in FIG. 1A, traditional metallic framing member 100 allows a high level of thermal transmission between the two planar construction components 110 and 111. Because flanges 102 and 103 are substantially coplanar with planar construction components 110 and 111, there is a large surface area of the flanges 102 and 103 which contacts planar construction components 110 and 111. This large contact surface area allows conductive heat transfer between the planar construction components 110 and 111 and the flanges 102 and 103. For example, where planar construction component 110 has a higher temperature than planar construction component 111, the contact surface area between planar construction component 110 and flange 102 easily conducts heat to flange 102. Traditional metallic framing member 100 allows heat to transfer across the web 101 to flange 103. The contact surface area between flange 103 and planar construction component 111 allows conductive heat transfer to planar construction component 111. In this manner, heat is transferred by traditional metallic framing member 100 from planar construction component 110 to planar construction component 111.

Figure 1B:
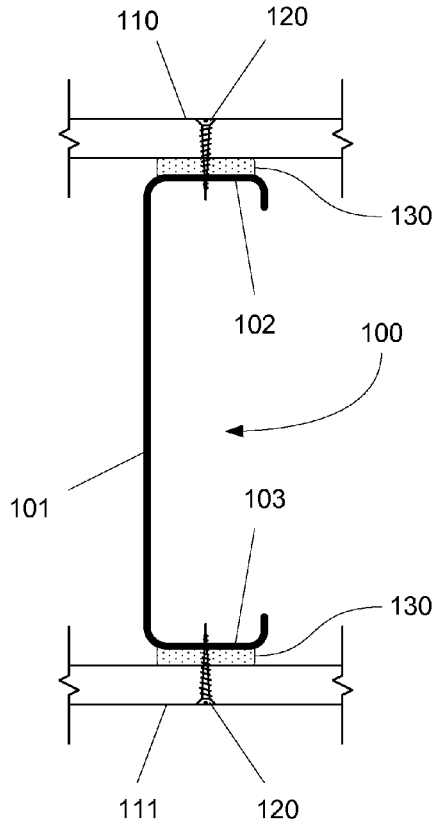
Figure 1B Prior Art
FIG. 1B illustrates a cross sectional view of a traditional metallic framing member in a construction assembly.

FIG. 1B illustrates a cross sectional view of traditional metallic framing member 100 in a construction assembly, and also illustrates an attempt to compensate for the conductive heat transfer between planar construction components 110 and 111. Prior attempts to cure the problems with thermal transfer have been to apply an insulative material 130 to flanges 102 and 103. Traditional metallic framing member 100 is secured to planar construction components 110 and 111 such that the insulative materials 130 are between flanges 102 and 103 and planar construction components 110 and 111. This assembly greatly reduces the heat transfer between flange 102 and planar construction components 110, and between flange 103 and planar construction components 111. However, the failure of this assembly is that the connection between flanges 102 and 103 and planar construction components 110 and 111 are not sufficient to create a solid structural connection. No portion of traditional metallic framing member 100 contacts planar construction components 110 and 111. Further, insulative materials 130 are generally pliable and would allow traditional metallic framing member 100 and planar construction components 110 and 111 to move independently of each other. Thus, the attempts to place insulative material 130 on the outside of flanges 102 and 103 do not allow for a structural connection between traditional metallic framing member 100 and planar construction components 110 and 111.

Figure 2A:
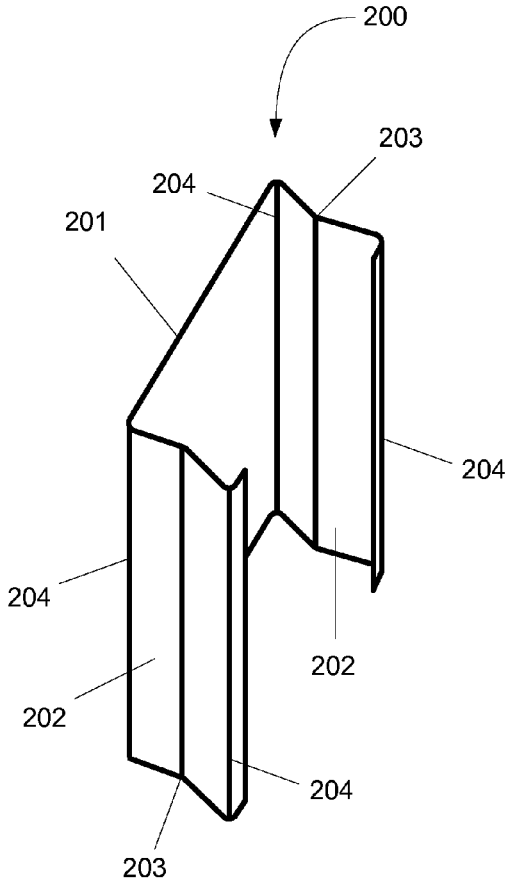
FIG. 2A illustrates an axonometric view of another metallic channel.

FIG. 2A illustrates an axonometric view of an another metallic channel 200 which has greater thermal transfer resistance than that of traditional metallic channel 100. Metallic channel 200 has a substantially planar web 201 connecting two flanges 202. Each of the flanges has a V-shaped inwardly-bent depression 203. The inwardly-bent depression 203 creates two contact ridges 204 for each of the two flanges 202.

Figure 2B:
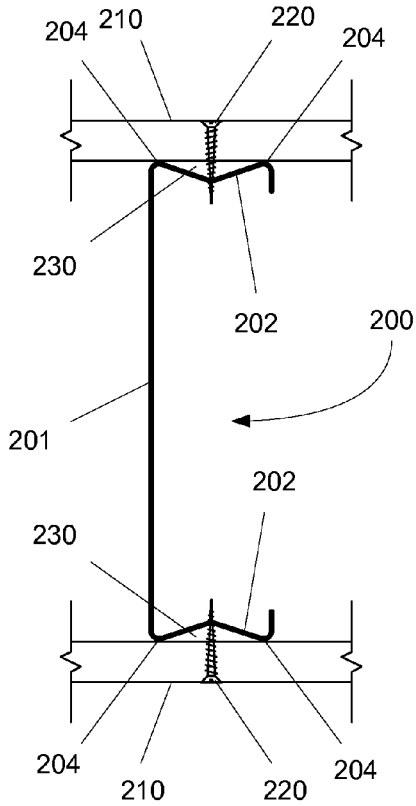
FIGS. 2B-2F depicts some of the drawbacks to using certain metallic channels.

FIG. 2B illustrates a cross sectional view of metallic channel 200 assembled into a construction assembly. Metallic channel 200 is secured to planar construction components 210 using fasteners 220. When securely fastened, the metallic channel 200 contacts planar construction components 210 at the contact ridges 204 from each of the two flanges 202. Thus, each flange 202 contacts the corresponding planar construction component 210 along only two contact ridges 204. Because the only contact between planar construction component 210 and metallic channel 200 are the two contact ridges 204, the amount of conductive heat transfer is greatly reduced.

FIG. 2B also depicts one of the drawbacks to using metallic channel 200. As depicted, the contact between planar construction component 210 and metallic channel 200 along the two contact ridges 204 creates an air pocket 230. The air pocket 230 allows for convective heat transfer between planar construction component 210 and inwardly-bent depression 202 via the air in the air pocket 230. Convective heat transfer generally transfers less heat than conductive heat transfer, and convective heat transfer is generally not as efficient when the air is substantially stagnant. However, some heat does transfer within air pocket 230, resulting in heat transfer between planar construction components 210. Thus, while metallic channel 200 is an improvement over traditional metallic channel 100, metallic channel 200 still permits some heat transfer.

Figure 2C:
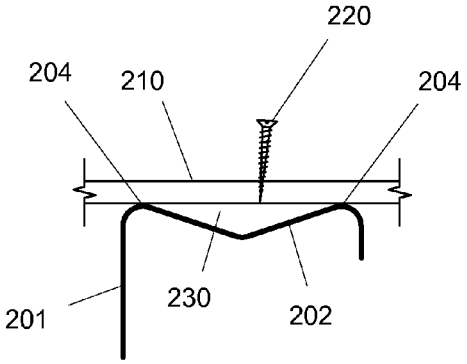
Figure 2D:
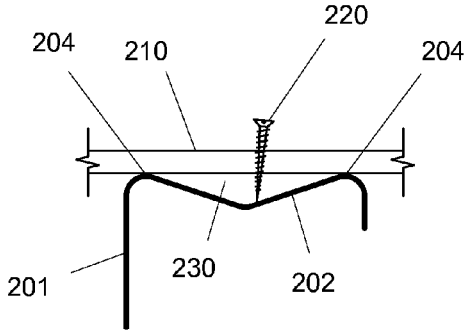
Figure 2E:
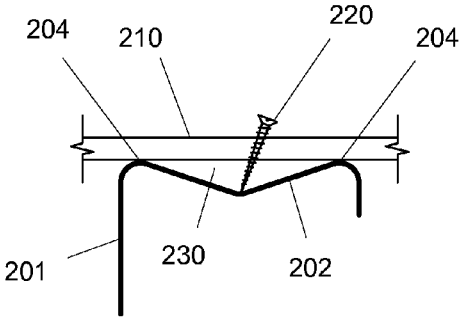
Figure 2F:
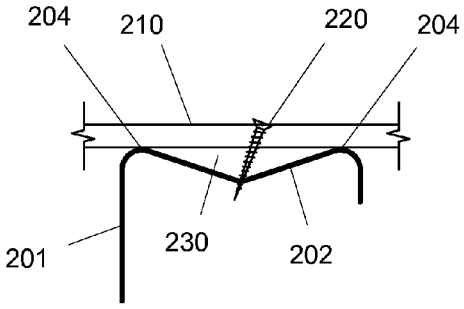

FIGS. 2C-2F depict a sequence of events highlighting one problem using fasteners 220 to secure metallic channel 200 to planar wall component 210. Fastener 220 enters planar wall component 210, as shown in FIG. 2C, and proceeds through air pocket 230 until it contacts inwardly-bent depression 202, as shown in FIG. 2D. Air pocket 230 does not provide any support to fastener 220. Depending on the strength of planar wall component 210, the fastener can rotate within air pocket 230 at this point. As shown in FIG. 2E, fastener 220 can rotate so that it is not perpendicular to planar wall component 210. Once fastener 220 is fully secured to planar wall component 210, the head of fastener 220 may stick out of planar wall component 210 which is not desirable in most construction situations.

Figure 3A:
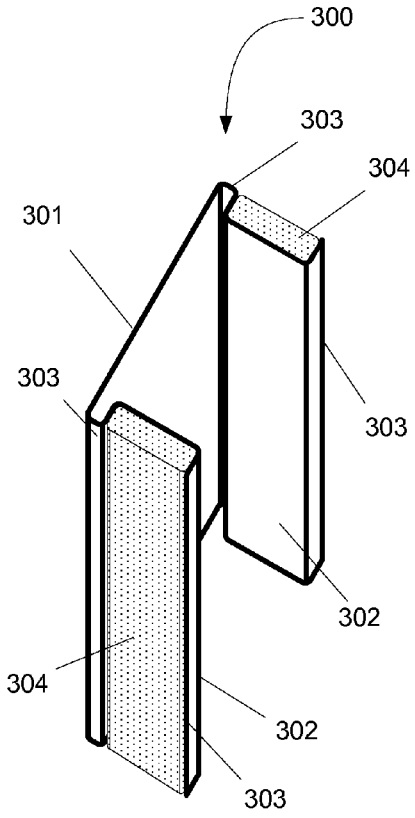
FIG. 3A depicts one embodiment of an insulative metallic channel.

FIG. 3A depicts one embodiment of an insulative metallic channel of the present invention. FIG. 3A depicts an insulated metallic channel 300 which includes a web 301 and two flanges 302. The flanges 302 are inwardly bent, creating two contact ridges 303 at each of the two flanges 302. The two contact ridges 303 of each flange 302 define a plane. The area between the plane defined by the contact ridges 303 and the inwardly bent flanges 302 is substantially filled with an insulative material 304. Insulative material 304 can be any type of material which resists heat transfer, such as foam, foam tape, Styrofoam, spray-in insulation, expanded insulators, fibrous insulators, polystyrene, polyurethane, polyisocyanurate, aerogel, or any other similar material. The insulative material 304 can also be rigid, such as a ceramic material, or semi-rigid, such as a porous foam. Insulative material 304 can be attached to inwardly-bent flange 302 by adhering the insulative material 304 to the inwardly-bent flange 302, by expanding the insulative material 304 into the inwardly-bent flange 302, or by spraying the insulative material 304 into the inwardly-bent flange 302. Insulative material 304 can be attached to inwardly-bent flange 302 either before or after the insulative metallic channel 300 is cut to the proper length.

Insulative metallic channels 300 are preferably formed from hot dipped galvanized strip steel having a generally uniform thickness throughout, but may also be formed from other metals. The material used is sufficiently malleable so that the insulative metallic channel 300 is formed from an integral piece having fold lines connecting the different portions. In addition, the metallic channels may also be produced from a number of other materials for which thermal conductivity is a concern. These materials include, but are not limited to, uncoated steel, stainless steel, and aluminum.

As depicted in FIG. 3A, the inwardly-bent depression of flange 302 is U-shaped with sides substantially parallel to web 301 and a bottom substantially perpendicular to web 301. While this is one embodiment of flange 302, many other configurations are possible. Some of those configurations are discussed below.

Figure 3B:
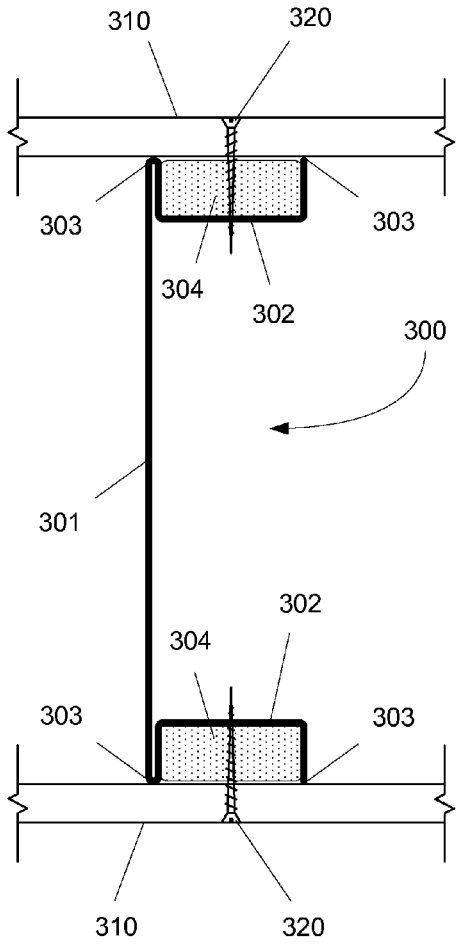
FIG. 3B depicts the insulative metallic channel in a construction assembly.

FIG. 3B depicts insulative metallic channel 300 in a construction assembly. There, insulative metallic channel 300 is placed between two planar construction components 310. The insulative metallic channel 300 contacts the two planar construction components 310 at ridges 303, and the insulative metallic channel 300 and the two planar construction components 310 are structurally attached using fasteners 320. As shown, insulative material 304 substantially fills the area between flanges 302 and the two planar construction components 310. Insulative material 304 does not necessarily contact the two planar construction components 310.

Insulative metallic channel 300 reduces the amount of heat transfer between planar construction components 310. Similar to metallic channel 200, because the only contact between planar construction component 310 and metallic channel 300 are the two contact ridges 303, the amount of conductive heat transfer is greatly reduced. In addition, there is no substantial air pocket created between flanges 302 and planar construction components 310 because insulative material 304 substantially fills the area between flanges 302 and the two planar construction components 310. Because there is no air pocket and because insulative material 304 generally resists any form of heat transfer, there is very little convective heat transfer between flanges 302 and planar construction components 310. Thus, the embodiment of the insulative metallic channel 300 shown in FIG. 3B reduces the overall heat transfer between planar construction components 310 from prior metallic channels without compromising the structural application of the metallic channel in the way that the assembly depicted in FIG. 1B has compromised structural integrity.

Figure 3C:
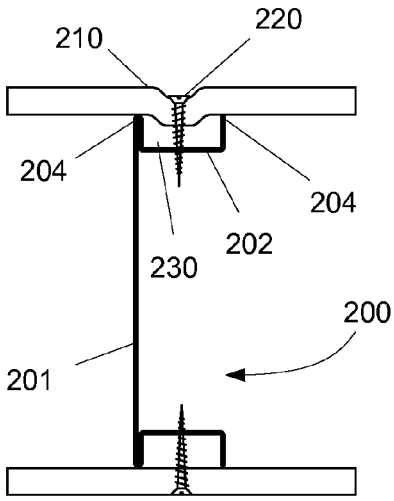
FIGS. 3C-3J depict advantages of the insulative metallic channel.
Figure 3D:
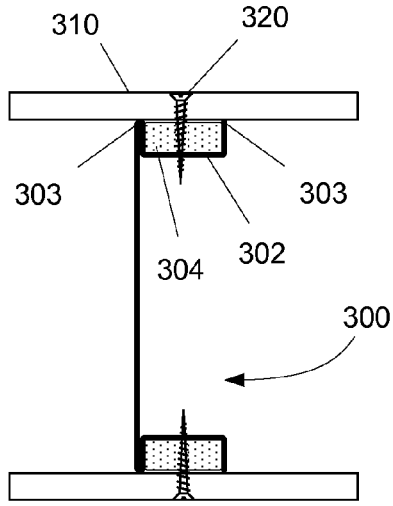
Figure 3E:
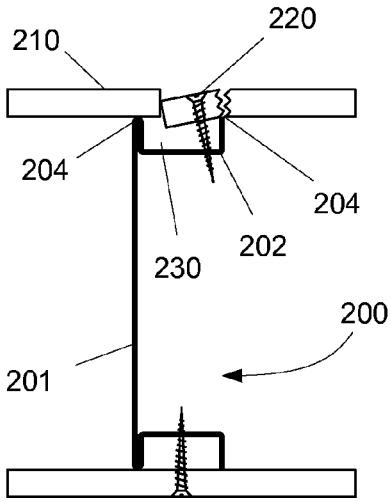
Figure 3F:
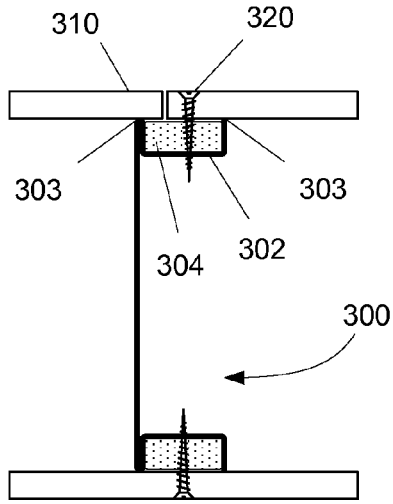

FIGS. 3C-3F depict further advantages of insulative metallic channel 300 over metallic channel 200. FIG. 3C depicts the use of metallic channel 200 in a construction assembly. Fastener 220 is used to secure planar construction component 210 to the flange 202 of metallic channel 200. As depicted, fastener 220 is a screw which has had too much torque applied to it, resulting in deformation of construction wall component 220. The air gap 230 between the planar construction component 210 and the flange 202 allows for the deformation of planar construction component 210. In contrast, FIG. 3D shows the use of insulative metallic structure 300. There, if too much torque is applied to fastener 320, the planar construction component will come into contact with the insulative material 304 which resists any movement by planar wall component 310. This resistance significantly reduces any deformation of planar wall component 310. FIG. 3E depicts a similar problem which is exacerbated by a seam of planar wall component 210 being located between the contact ridges 204. In this instance, if too much torque is applied to fastener 220, a portion of planar wall component 210 can break off, resulting in significant deformation. FIG. 3F depicts how the use of insulative metallic channel 300 can reduce the likelihood of breaking planar wall component 310. There, the insulative material 304 again resists any motion of the planar wall component 310, this reducing the likelihood that the planar construction component 310 will break, even when there is a seam of construction component 310 located between two contact ridges 303.

Figure 3G:
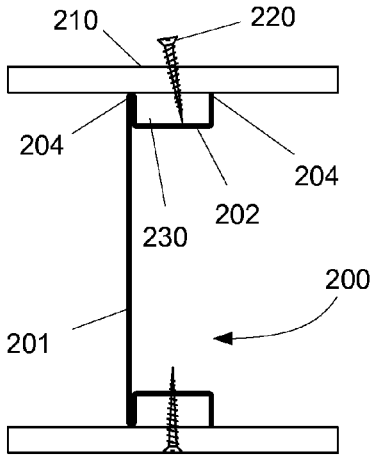
Figure 3H:
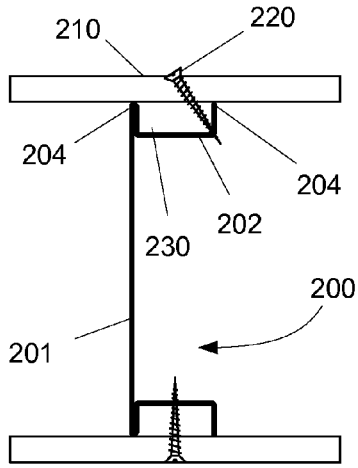
Figure 3I:
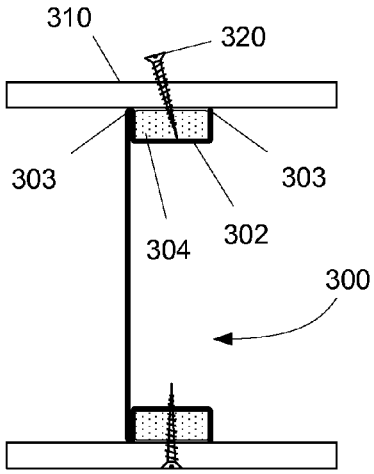
Figure 3J:
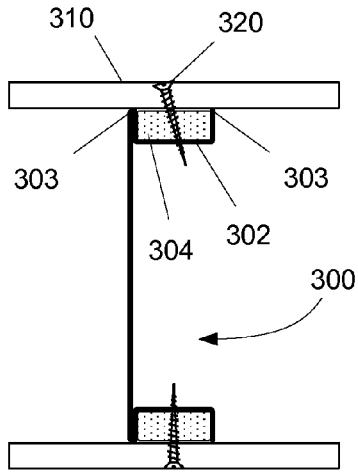

FIGS. 3G-3J depict even further advantages of insulative metallic channel 300 over metallic channel 200. FIGS. 3G and 3H depict a problem similar to that discussed above with respect to FIGS. 2C and 2D, where the fastener 220 can rotate within air pocket 230. FIG. 3G depicts fastener 220 passing through planar construction component 210 and contacting flange 202. Depending on the strength of planar construction component 210 and the forces applied to the fastener 220, fastener 220 may rotate within air pocket 230 to an undesirable position, as shown in FIG. 3H. FIGS. 3I and 3J depict how the user of insulative metallic channel 300 can prevent this problem. In FIG. 3I, fastener 320 has passed through planar construction component 310 and insulative material 304 to contact flange 302. Insulative material 304 will resist an lateral movement of fastener 320. Thus, insulative material 304 acts as a guide and reduces the likelihood that fastener 320 will rotate within the area between planar construction component 310 and flange 302. As shown in FIG. 3J, fastener 320 passed through flange 302 at an angle similar to the one at which the fastener entered planar construction component 310.

Figure 4:
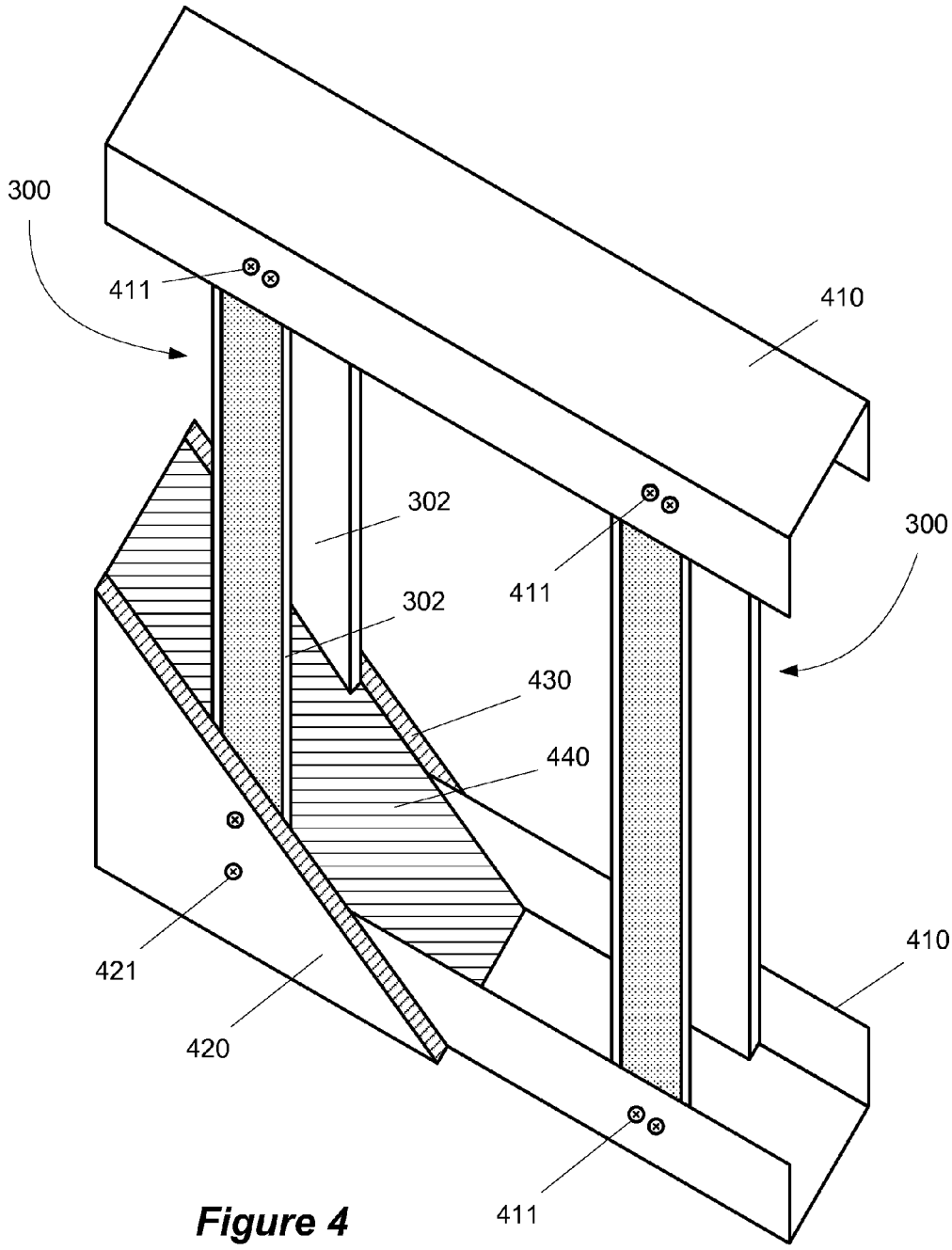
FIG. 4 illustrates an axonometric view showing portions of several construction components as they are arranged in a built assembly.

FIG. 4 illustrates an axonometric view showing portions of several construction components as they are arranged in a built assembly. Two insulative metallic channels 300 are depicted attached at their ends to metallic runner channels 410 using mechanical fasteners such as screws 411. Runner channels 410 are generally U-shaped in cross section. On one face of the built assembly, a planar construction component 420 is affixed to flange 302 of insulative metallic channel 300 using mechanical fasteners 421. Configured in this way, the U-shaped cross section provides a socket for receiving the longitudinal extremity of the flange 302. On an opposite side of the built assembly, a planar construction component 430 is affixed to flange 302 of insulative metallic channel 300 and flange 302 of metallic runner channel 410 using mechanical fasteners 411. Preferably, planar construction component 420 and 430 have at least one planar surface. In the present instance, planar construction components 420 and 430 have two parallel planar surfaces. Preferably, a second one of the longitudinal extremities of the flanges 302 is positioned along a second longitudinal extremity of one of the planar construction components 420 and 430, and a second runner track 410 provides a second socket for receiving the second longitudinal extremity of the flange. A fastener 411 rigidly connects the second longitudinal extremity of the flanges in the second socket and one of the planar construction components 420 and 430. An insulating material 440 is positioned within a cavity formed by insulative metallic channel 300 and adjacent planar construction components 420 and 430. Both planar construction components 420 and 430 may vary in composition as they are not critical to individual performance of insulative metallic channel 300 described herein.

Figure 5:
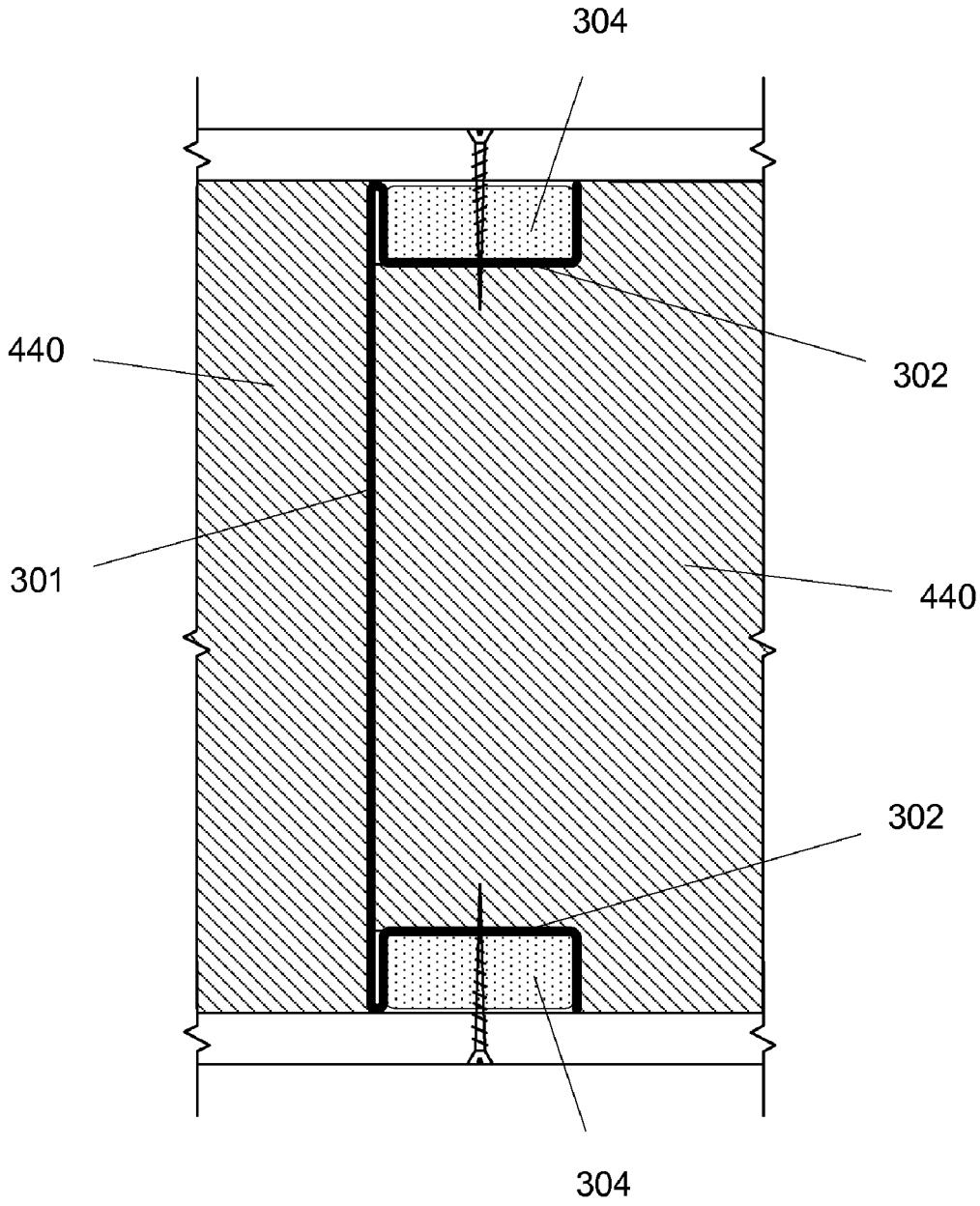
FIG. 5 depicts a cross-sectional view of a built assembly.
Figure 6A:
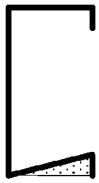
FIGS. 6A-12G depict a number cross sectional configurations for various embodiments of insulative metallic channel.
Figure 6B:
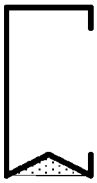
Figure 6C:
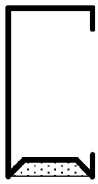
Figure 6D:
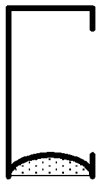
Figure 6E:
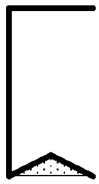
Figure 6F:
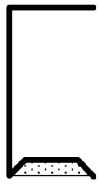
Figure 6G:
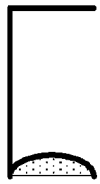
Figure 7A:
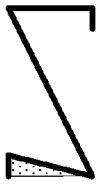
Figure 7B:
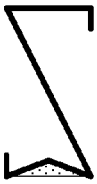
Figure 7C:
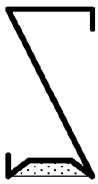
Figure 7D:
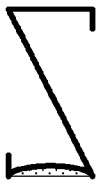
Figure 7E:
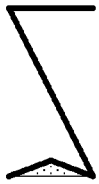
Figure 7F:
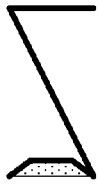
Figure 7G:
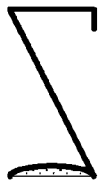
Figure 8A:
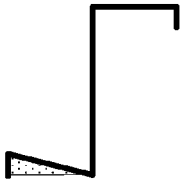
Figure 8B:
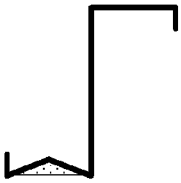
Figure 8C:
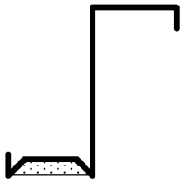
Figure 8D:
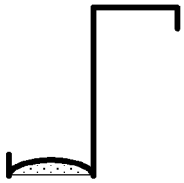
Figure 8E:
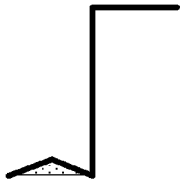
Figure 8F:
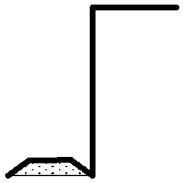
Figure 8G:
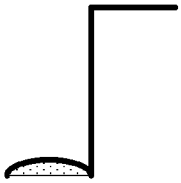
Figure 9A:
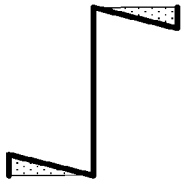
Figure 9B:
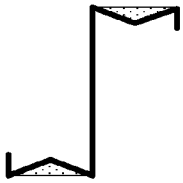
Figure 9C:
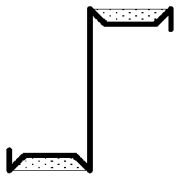
Figure 9D:
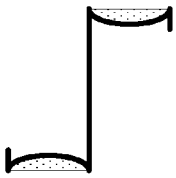
Figure 9E:
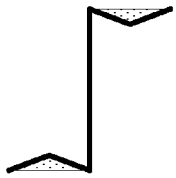
Figure 9F:
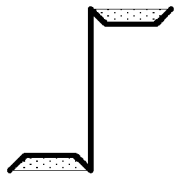
Figure 9G:
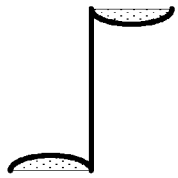
Figure 10A:
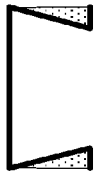
Figure 10B:
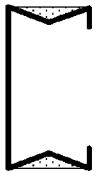
Figure 10C:
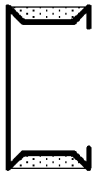
Figure 10D:
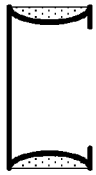
Figure 10E:
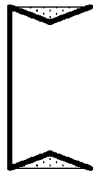
Figure 10F:
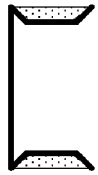
Figure 10G:
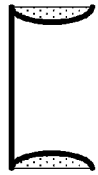
Figure 11A:
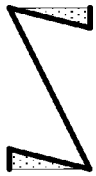
Figure 11B:
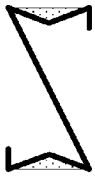
Figure 11C:
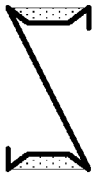
Figure 11D:
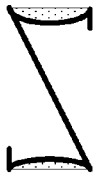
Figure 11E:
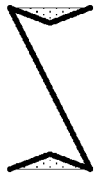
Figure 11F:
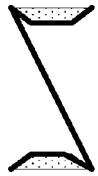
Figure 11G:
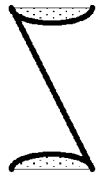
Figure 12A:
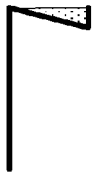
Figure 12B:
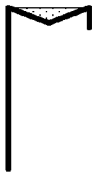
Figure 12C:
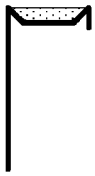
Figure 12D:
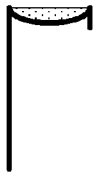
Figure 12E:
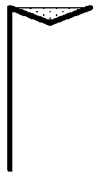
Figure 12F:
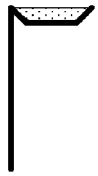
Figure 12G:
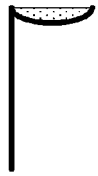

As is depicted in FIG. 4, an insulating material 440 may substantially fill the area between successive insulative metallic channels 300. In addition an insulating material 440 may also substantially fill the area bounded by web 301 and flanges 302. A cross-sectional view of the assembly is depicted in FIG. 5. There, it can be seen that insulative material 440 substantially fills the area bounded by web 301 and flanges 302. As is also evident, the combination of insulative material 304 and insulative material 440 substantially fill all the areas between planar construction components 420 and 430 and all of the areas surrounding insulative metallic channels 300.

While the built assembly of FIG. 4 is depicted with two planar construction components 420 and 430, it would be well understood by one of ordinary skill in the art that the built assembly could contain only one planar construction component. This situation may arise in built assemblies such as a roof assembly or a floor assembly. Similarly, it would be well-understood by one of ordinary skill in the art that, while the use of runner channels 410 may be desirable in some built assemblies, runner channels are not necessary components in every built assembly.

FIGS. 6A through 12G depict a number cross sectional configurations for various embodiments of insulative metallic channel 300. Each of the embodiments shown in FIGS. 6A through 12G include an inwardly-bent depressions in at least one flange, and the inwardly bend depression of the flange is substantially filled with an insulative material. The cross-sectional shapes of the various inwardly-bent depressions includes triangular (e.g., FIGS. 6A, 6B, and 6E), trapezoidal (e.g., FIGS. 6C and 6F), and arcuate (e.g., FIGS. 6D and 6G). Other cross-sectional shapes include U-shaped, such as the shape depicted in FIG. 3A. The embodiments show in FIGS. 6A through 12G are intended to show some of the many possible flange configurations and should not be read to limit the present invention in any way.

Figure 13A:
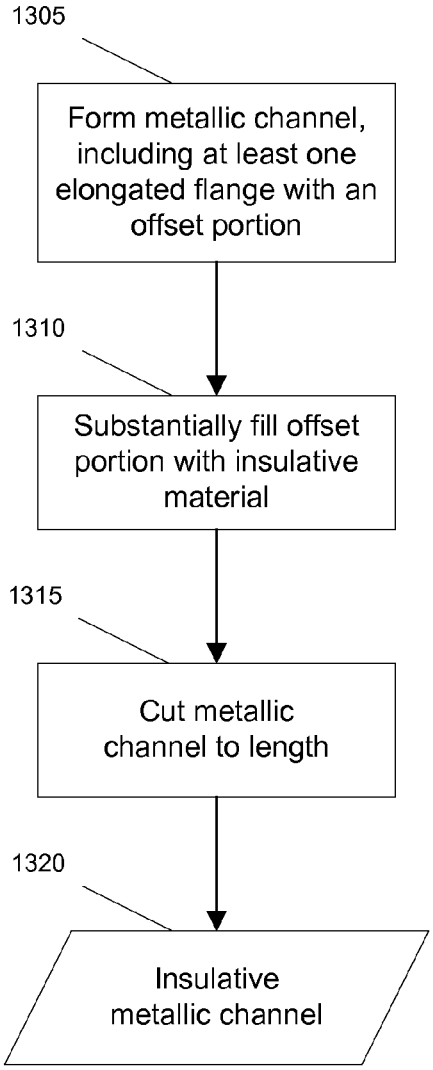
FIGS. 13A-13B are flowcharts of illustrative methods for manufacturing insulative metallic channels.
Figure 13B:
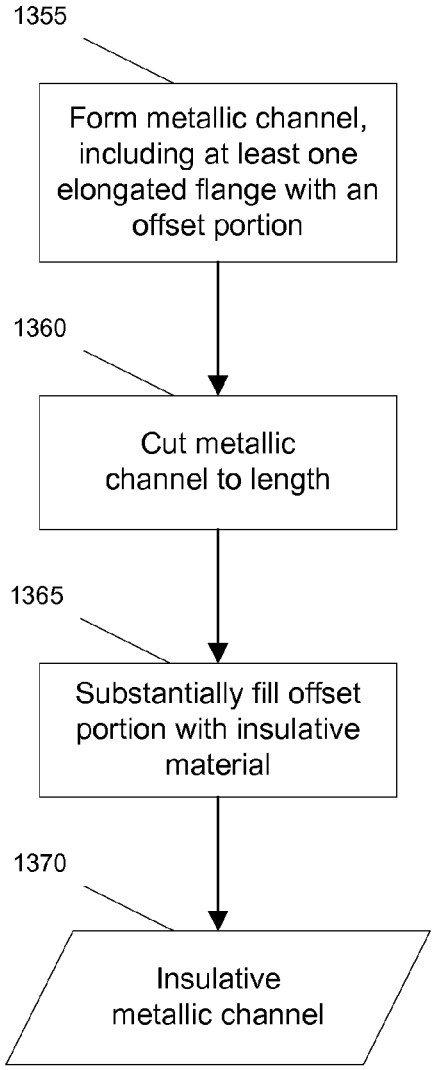

Another aspect of the present invention is the manufacturing of the insulative metallic channels 300. FIGS. 13A and 13B depict possible methods for manufacturing insulative metallic channels 300. As shown in FIG. 13A, the metallic portion of the channel is formed 1305. The forming process may include forming the metallic channel from a single piece of metal sufficiently malleable as to form the web 301 and flanges 302 by bending a single piece of metal. Alternatively, the insulative metallic channels 300 can be formed by hot of cold rolling metal to maintain the appropriate cross-section for the web 301 and flanges 302. In another possible method, multiple pieces of metal may be welded together to form the web 301 and flanges 302 of insulative metallic channels 300. Many other methods are known for forming metals into those embodiments of insulative metallic channels 300 within the scope of the present invention.

Once the metallic portion of the channel is formed 1305, the offset portion of at least one flange 302 can be substantially filled 1310 with insulative material 304. The insulative material can be sprayed onto the offset portion of the flange, it can be adhered onto the offset portion of the flange, it can be expanded into the offset portion of the flange, or any other similar method. After the offset portion is substantially filled, the metallic channel can be cut to length 1315. The result 1320 is one embodiment of insulative metallic channel 300. The method depicted in FIG. 13A may be more desirable in situations where the metallic portion of insulative metallic channel 300 can be formed in one continuous cross-section, such as cold rolling. In such a case, applying the insulative material to the flange 302 may be better done as the metallic portion of insulative metallic channel 300 emerges from the cold rolling process and before the insulative metallic channel 300 is cut to length.

FIG. 13B depicts a similar method for manufacturing insulative metallic channels 300. As shown in FIG. 13B, the metallic portion of the channel is formed 1355. In this instance, the metallic portion is first cut to length 1360, and then the offset portion of at least one flange 302 can be substantially filled 1365 with insulative material 304. The result 1370 of this process is one embodiment of insulative metallic channel 300. The process depicted by FIG. 13B may be more desirable in situations where the metallic portion of insulative metallic channel 300 is formed from substantially one piece of malleable metal by bending the metal into shape.

Figure 14:
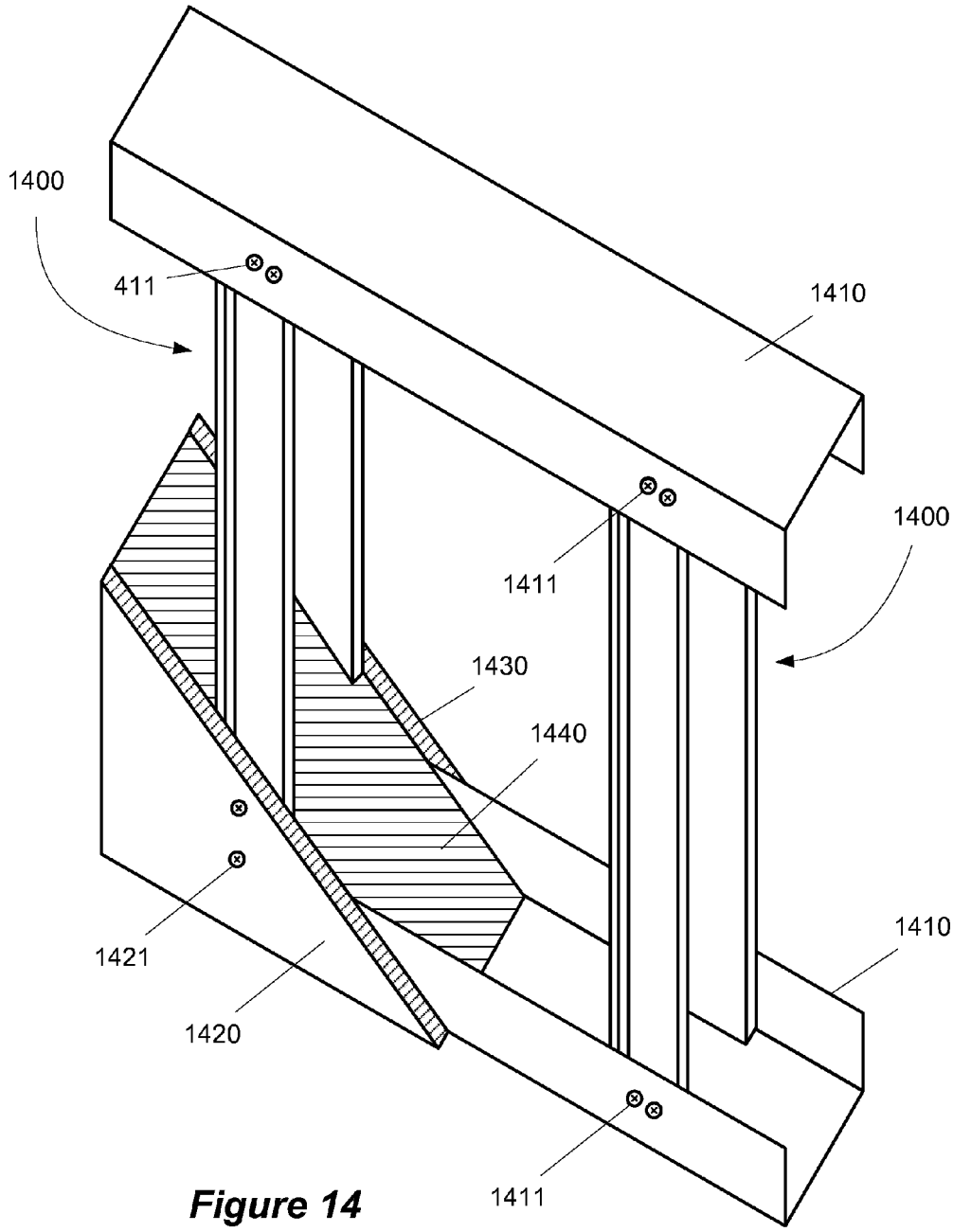
FIG. 14 depicts one embodiment of an acoustically dampening construction assembly.

Another aspect of the present invention is a method for designing acoustically dampening construction assemblies. FIG. 14 depicts one embodiment of an acoustically dampening construction assembly. Two structural metallic channels 1400, which can be either structural metallic channel 200 or insulative structural metallic channel 300, are attached to metallic runner channels 1410 using mechanical fasteners such as screws 1411. Runner channels 1410 are generally U-shaped in cross section. On one face of the built assembly, a planar construction component 1420 is affixed to metallic runner channels 1410 using mechanical fasteners 1421. Configured in this way, the U-shaped cross section provides a socket for receiving the longitudinal extremity of metallic runner channels 1410. On an opposite side of the built assembly, an planar construction component 1430 is affixed to metallic channel 1400 and to metallic runner channel 1410 using mechanical fasteners 1411.

Using metallic channel 200, as depicted in FIG. 2A, as an embodiment of metallic channel 1400, metallic channels have at least one flange 202 which has two contact ridges 204, and an inwardly-bent depression 203. The rides are positioned such that the metallic channel 1400 contacts an adjacent planar construction component 1420 only along the two contact ridges 204. In this matter, the amount of contact between metallic channel 1400 and the planar construction component 1420 is minimized while still maintaining a structural connection when the two are fastened together. This minimal physical contact results in less vibration transferring via metallic channel 1400 from planar construction component 1420 to planar construction component 1430, and vice versa.

Prior construction designs typically use "resilient channels" for acoustic dampening in construction assemblies. The problem with resilient channels is that they are not structural components and must be installed into construction assemblies in addition to the installation of structural components. The advantage of designing an acoustically dampening construction assembly as depicted in FIG. 14 is that the structural metallic channels 1400 are structural components and they provide acoustic dampening, thereby reducing the overall number of components required in an acoustically dampening construction assembly.

Figure 15:
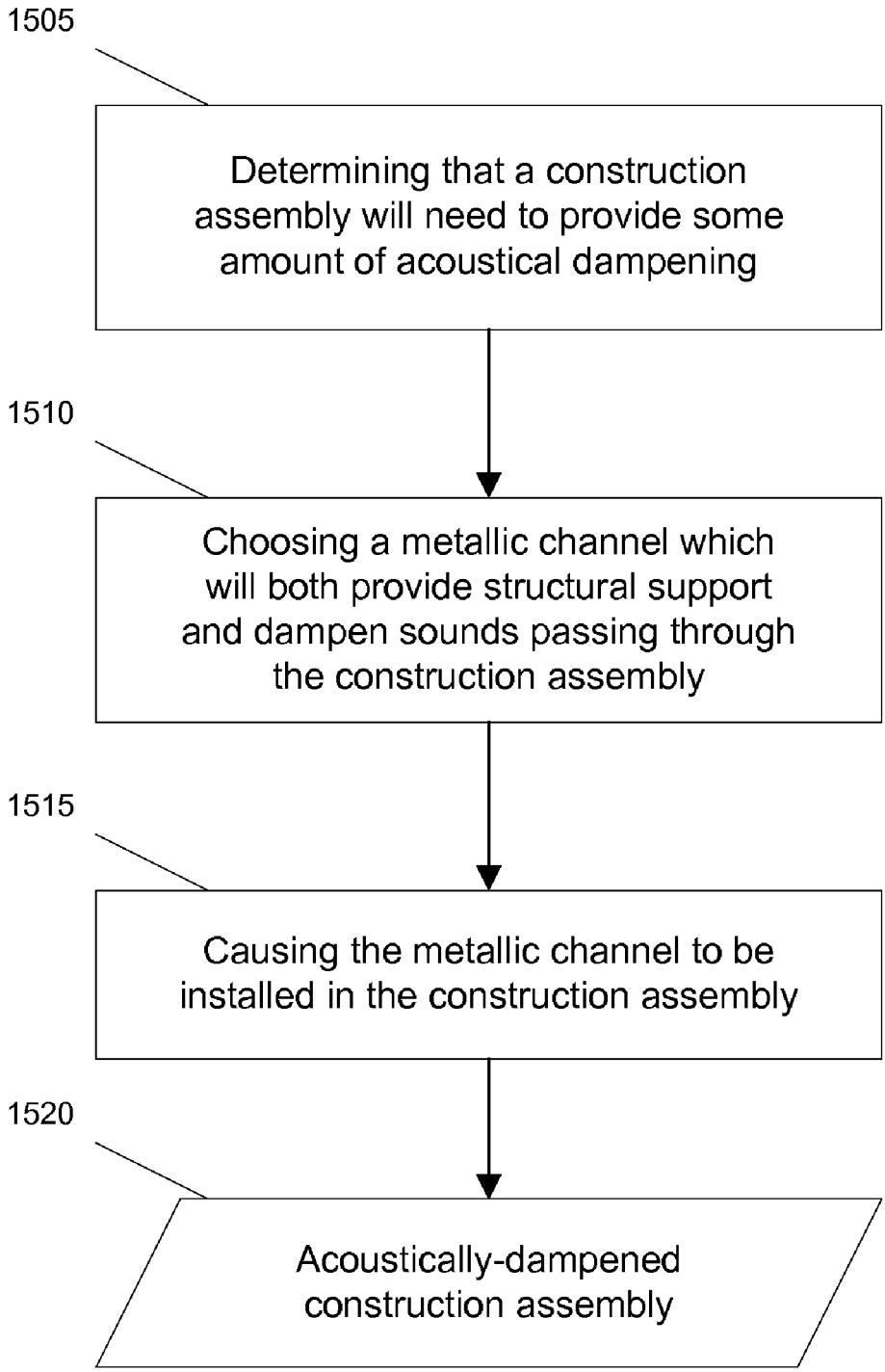
FIG. 15 is a flowchart of an illustrative method for designing acoustically dampening construction assemblies.

FIG. 15 depicts a method for designing acoustically dampening construction assemblies. The method includes determining 1505 that a construction assembly will need to provide some amount of acoustic dampening. A metallic channel is then chosen 1510 which will both provide structural support and dampen sounds passing through the construction assembly. The metallic channel could be either of the metallic channel 200 or the metallic channel 300 described above. The metallic channel is then caused 1515 to be placed in the construction assembly, resulting 1520 in an acoustically dampened construction assembly.

While the above description contains many specifications, these should not be construed as limitations on the scope of the invention, but rather as examples of embodiments of the invention. Many other variations on the described metallic channels, assemblies, and methods are possible. Therefore, the scope of the invention should not be limited to those specific embodiments depicted and described above, but by the claims which follow.

What is claimed:

1. A method of constructing an acoustically dampening construction assembly, comprising:

determining that a construction assembly will need to provide some amount of acoustic dampening;

choosing a metallic channel both for providing structural support to the construction assembly and for dampening sound passing through the construction assembly, the metallic channel comprising:

an elongated web, at least one elongated flange extending transversely from the web, the at least one elongated flange comprising first and second continuous ridges along the length of the at least one elongated flange, the at least one elongated flange further comprising an offset portion laterally spaced inwardly from the first and second ridges, the offset portion bordered by the first and second continuous ridges and spanning approximately the entire width of the at least one elongated flange along the length of the metallic channel, and an insulative material disposed on the offset portion of the at least one elongated flange, wherein the insulative material has an outer surface which is substantially flush with the first and second ridges and wherein the insulative material substantially fills the area between the outer surface and the offset portion, and wherein the insulative material comprises at least one material of the group consisting of foam, foam tape, spray-in insulation, expanded insulation, fibrous insulation, polystyrene, polyurethane, polyisocyanurate, aerogel, ceramic insulation, and porous foam insulation; and causing the metallic channel to be installed in the construction assembly such that the first and second ridges contact an inner edge of a planar construction component with the offset portion laterally spaced apart from the planar construction component.

2. The method of claim 1, wherein the construction assembly is a wall.

3. The method of claim 1, wherein the construction assembly is a ceiling.

4. The method of claim 1, wherein the metallic channel further comprises:

an insulative material covering the offset portion of the at least one elongated flange.

5. The method of claim 1, wherein the offset portion has a cross-sectional shape selected from the group consisting of: triangular, trapezoidal, arcuate, and U-shaped.

6. The method of claim 1, wherein the insulative material is configured to resist deformation of a wall component when the wall component is in contact with at least one of the first and second ridges.

7. An insulative structural metallic channel, comprising:

an elongated web;

at least one elongated flange extending transversely from the web, the at least one elongated flange comprising first and second ridges along the length of the at least one elongated flange, the at least one elongated flange further comprising an offset portion laterally spaced inwardly from the first and second ridges, the offset portion bordered by the first and second ridges and spanning approximately the entire width of the at least one elongated flange along the length of the metallic channel; and an insulative material disposed on and substantially covering the offset portion of the at least one elongated flange, wherein the insulative material has an outer surface which is substantially flush with the first and second ridges and wherein the insulative material substantially fills the area between the outer surface and the offset portion, and wherein the insulative material comprises at least one material of the group consisting of foam, foam tape, spray-in insulation, expanded insulation, fibrous insulation, polystyrene, polyurethane, polyisocyanurate, aerogel, ceramic insulation, and porous foam insulation.

8. The insulative metallic channel of claim 7, wherein the insulative material comprises at least one material of the group consisting of foam and foam tape.

9. The insulative metallic channel of claim 7, wherein the insulative material comprises spray-in insulation.

10. The insulative metallic channel of claim 7, wherein the insulative material comprises at least one material of the group consisting of expanded insulation and fibrous insulation.

11. The insulative metallic channel of claim 7, wherein the insulative material comprises at least one material of the group consisting of polystyrene, polyurethane, polyisocyanurate, and aerogel

12. The insulative metallic channel of claim 7, wherein the elongated web and the at least one elongated flange comprises a material selected from the group consisting of: galvanized strip steel, uncoated steel, stainless steel, and aluminum.

13. The insulative metallic channel of claim 7, wherein the elongated web and the at least one elongated flange are formed from a single integral piece of metal.

14. The insulative metallic channel of claim 7, wherein the offset portion has a cross-sectional triangular shape.

15. The insulative metallic channel of claim 7, wherein the offset portion has a cross-sectional trapezoidal shape.

16. The insulative metallic channel of claim 7, wherein the offset portion has a cross-sectional arcuate shape.

17. The insulative metallic channel of claim 7, wherein the offset portion has a cross-sectional U shape.

18. The insulative structural metallic channel of claim 7, wherein the insulative material is configured to resist deformation of a wall component when the wall component is in contact with at least one of the first and second ridges.

19. A construction assembly, comprising:

a first planar construction component;

a first metallic channel comprising:

an elongated web, at least one elongated flange extending transversely from the web, the at least one elongated flange comprising first and second continuous ridges along the length of the at least one elongated flange, the at least one elongated flange further comprising an offset portion laterally spaced inwardly from the first and second ridges, the offset portion bordered by the first and second ridges and spanning approximately the entire width of the at least one elongated flange along the length of the first metallic channel, and an insulative material disposed on the offset portion of the at least one elongated flange, wherein the insulative material has an outer surface which is substantially flush with the first and second ridges and wherein the insulative material substantially fills the area between the outer surface and the offset portion, and wherein the insulative material comprises at least one material of the group consisting of foam, foam tape, spray-in insulation, expanded insulation, fibrous insulation, polystyrene, polyurethane, polyisocyanurate, aerogel, ceramic insulation, and porous foam insulation; and a fastener connecting the first planar construction component against the first and second ridges of the at least one elongated flange of the first metallic channel, the fastener extending through the first planar construction component, through the insulative material, and through the at least one elongated flange to connect the first planar construction component to the at least one elongated flange.

20. The construction assembly of claim 19, further comprising:

a bottom metallic runner having a substantially flat face and at least one substantially flat flange extending transversely from the flat face, wherein the first metallic channel is disposed transverse to the bottom metallic runner.

21. The construction assembly of claim 19, wherein the insulative material substantially fills the space between the offset portion and the first planar construction component.

22. The construction assembly of claim 19, further comprising:

a second planar construction component connected to a second elongated flange of the first metallic channel; and a second metallic channel connected to the first and second planar construction components, wherein the first and second metallic channels are spaced apart from each other.

23. The construction assembly of claim 22, further comprising:

an insulative material substantially filling the space bounded by the first and second metallic channels and the first and second planar construction components.

24. The construction assembly of claim 22, further comprising:

an insulative material substantially filling the space between an offset portion of the second elongated flange and the second planar construction component.

25. The construction assembly of claim 19, wherein the insulative material is configured to resist deformation of a wall component when the wall component is in contact with at least one of the first and second ridges.

* * * * *